US008562387B1

(12) United States Patent
Henthorne

(10) Patent No.: US 8,562,387 B1
(45) Date of Patent: Oct. 22, 2013

(54) DRIVING MECHANISM FOR REMOTE CONTROL TOY VEHICLE

(76) Inventor: Gary R. Henthorne, Vanzant, MO (US)

( * ) Notice: Subject to any disclaimer, the term of this patent is extended or adjusted under 35 U.S.C. 154(b) by 269 days.

(21) Appl. No.: 13/084,046

(22) Filed: Apr. 11, 2011

Related U.S. Application Data

(60) Provisional application No. 61/322,329, filed on Apr. 9, 2010.

(51) Int. Cl.
*A63H 17/00* (2006.01)

(52) U.S. Cl.
USPC ..... 446/431; 446/456; 446/460; 180/167; 180/218

(58) Field of Classification Search
USPC ..... 446/454, 456, 437, 470, 469, 460, 431, 446/471, 465; 180/167, 218
See application file for complete search history.

(56) References Cited

U.S. PATENT DOCUMENTS

| | | | | |
|---|---|---|---|---|
| 4,163,567 | A * | 8/1979 | Barber | 180/218 |
| 4,576,583 | A * | 3/1986 | Yoneda | 446/471 |
| 4,577,528 | A | 3/1986 | Hanzawa | |
| 4,655,724 | A | 4/1987 | Law | |
| 4,710,147 | A | 12/1987 | Wakase | |
| 4,897,070 | A | 1/1990 | Wagstaff | |
| 5,892,350 | A * | 4/1999 | Yoshikawa | 446/454 |
| 6,475,059 | B1 * | 11/2002 | Lee | 446/454 |
| 6,726,524 | B2 * | 4/2004 | Yamaguchi et al. | 446/431 |
| 6,752,231 | B2 | 6/2004 | Hume | |
| 6,752,684 | B1 * | 6/2004 | Lee | 446/456 |
| RE38,665 | E * | 12/2004 | Struck et al. | 180/167 |
| 7,056,185 | B1 * | 6/2006 | Anagnostou | 446/456 |
| 7,188,694 | B1 | 3/2007 | Blair | |
| 7,261,615 | B2 * | 8/2007 | Hoeting et al. | 446/456 |
| 7,563,151 | B2 * | 7/2009 | Leonov et al. | 446/456 |
| 7,677,345 | B2 * | 3/2010 | Hosoda | 180/218 |
| 2002/0011368 | A1 * | 1/2002 | Berg | 180/218 |
| 2005/0134014 | A1 | 6/2005 | Xie | |
| 2008/0020670 | A1 * | 1/2008 | Kratz | 446/175 |

* cited by examiner

*Primary Examiner* — Gene Kim
*Assistant Examiner* — Urszula M Cegielnik
(74) *Attorney, Agent, or Firm* — Montgomery Patent & Design; Robert C. Montgomery

(57) ABSTRACT

A driving mechanism for a radio-controlled toy vehicle is disclosed comprising a radio controlled drive assembly with a frame, two (2) large central wheels, and two (2) small motor driven drive wheels. The large wheels are driven by two (2) independent motors with drive wheels attached which engage the outer perimeter of each large wheel. The drive train and power supply are positioned upon a platform of the frame. Front and rear midpoints of the frame are provided with a finger protrusion to support the vehicle when changing directions or when balance is lost. The wheels are driven independently enabling one (1) wheel to be driven forward while the other one (1) is driven backwards to allow the vehicle to spin in place about a center point. The motors can be driven in a simultaneous manner to propel the vehicle forward or backward. Proportional steering enables the vehicle to turn corners and produce movements that follow curves or arcs.

17 Claims, 5 Drawing Sheets

DRIVING MECHANISM FOR REMOTE CONTROL TOY VEHICLE

RELATED APPLICATIONS

The present invention was first described in and claims the benefit of U.S. Provisional Application No. 61/322,329 filed Apr. 9, 2010, the entire disclosure of which is incorporated herein by reference.

FIELD OF THE INVENTION

The present invention relates generally to remote-controlled, motor-driven toy vehicles, and in particular, to a driving mechanism for a remote-controlled, motor-driven toy vehicle.

BACKGROUND OF THE INVENTION

Various attempts have been made to provide driving mechanisms for toy vehicles. Examples of these attempts can be seen by reference to several U.S. patents. U.S. Pat. No. 4,577,528, issued in the name of Hanzawa, describes a driving/turnaround device for use with a toy vehicle including a reversible motor, an intermediate gear, and a pair of axles independently provided for right and left driving wheels, and a swing member rotatably mounted to the car body with a pair of switch gears providing stable turnaround of the toy vehicle.

U.S. Pat. No. 4,655,724, issued in the name of Law, describes a steering and drive system for toy vehicles utilizing only a single motor, wherein independent gear trains allow the motor to either rotate all wheels in the same direction to move the vehicle in a straight line or, by reversing the direction of the motor, rotate wheels on opposite sides of the vehicle in opposite directions causing the vehicle to turn.

U.S. Pat. No. 4,897,070, issued in the name of Wagstaff, describes a two-wheeled toy includes a central housing supported on a rotatable shaft between the wheels, where the shaft extends outwardly from the wheels to prevent the wheels from falling sideways.

While these apparatuses fulfill their respective, particular objectives, each of these references suffer from one (1) or more of the aforementioned disadvantages. Many such apparatuses are difficult to maneuver over rough, uneven surfaces such as gravel or carpeting. Also, many such apparatuses do not provide a desirable range of control for navigating such surfaces. Furthermore, many such apparatuses are not sufficiently resilient against shocks and rocking motion while navigating such surfaces. Accordingly, there exists a need for a driving mechanism for a remote-controlled toy vehicle without the disadvantages as described above. The development of the present invention substantially departs from the conventional solutions and in doing so fulfills this need.

SUMMARY OF THE INVENTION

In view of the foregoing references, the inventor recognized the aforementioned inherent problems and observed that there is a need for a driving mechanism for a remote-controlled toy vehicle with provisions for navigating rough terrain in a smooth, controlled manner. Thus, the object of the present invention is to solve the aforementioned disadvantages and provide for this need.

To achieve the above objectives, it is an object of the present invention to provide a driving mechanism including a pair of large wheels adapted to travel on rough grade such as gravel, carpeting, or the like. The wheels are mounted to a platform which further supports various electrical and mechanical components of the apparatus.

Another object of the present invention is to provide a stabilizing finger located on a lower surface of the platform to prohibit the apparatus from rocking while in motion.

Yet still another object of the present invention is to provide a removably attachable railing for the platform to retain a toy such as a doll or action figure during use.

Yet still another object of the present invention is to attach the wheels to the platform with a wheel brace and a pair of independent axles which enable independent operation of each wheel. The wheels may further include differing visual indicators such that a user can determine from a distance which wheel corresponds to a particular joystick of a remote control.

Yet still another object of the present invention is to operate the wheels with a pair of motor devices, preferably a pair of servo driven wheels. In use, the servo wheels engage a circumferential surface of the wheels and provide a proportional rotational motion to the wheels. Each servo wheel is powered by an independent drive motor.

Yet still another object of the present invention is to provide control circuitry including minimally a receiver, a microcontroller, a power source, and associated electrical wiring. The power source is preferably a replaceable battery providing additional weight to the rear of the apparatus to enhance stabilization and control during operation.

Yet still another object of the present invention is to mount the drive motors on a pair of rotating members which are hingedly connected to a support beam attached to the platform. The rotating members are further attached to the support beam by a pair of springs which provide flexibility between the wheels and the drive wheels while ensuring that the drive wheels engage the wheels securely during operation.

Yet still another object of the present invention is to provide the platform with an enclosing structure that houses and protects the electrical and mechanical components of the apparatus from debris and impacting forces.

Yet still another object of the present invention is to provide the remote control with a plurality of controls including the joysticks and a plurality of switches. The joysticks control the driving features of the apparatus including forward and backward motion as well as independent left or right turning of each wheel. The switches preferably provide activation and deactivation of the remote control, the frequency of the control, and inversion of the controls. The remote control includes a power source and a transmitter in wireless communication with the receiver of the vehicle.

Yet still another object of the present invention is to provide a method of utilizing the device that provides a unique means of utilizing the remote control to operate the toy vehicle in a manner that provide controlled, stabile operation over rough surfaces.

Further objects and advantages of the present invention will become apparent from a consideration of the drawings and ensuing description.

BRIEF DESCRIPTION OF THE DRAWINGS

The advantages and features of the present disclosure will become better understood with reference to the following more detailed description and claims taken in conjunction with the accompanying drawings, in which like elements are identified with like symbols, and in which:

DESCRIPTIVE KEY

Figure 1:
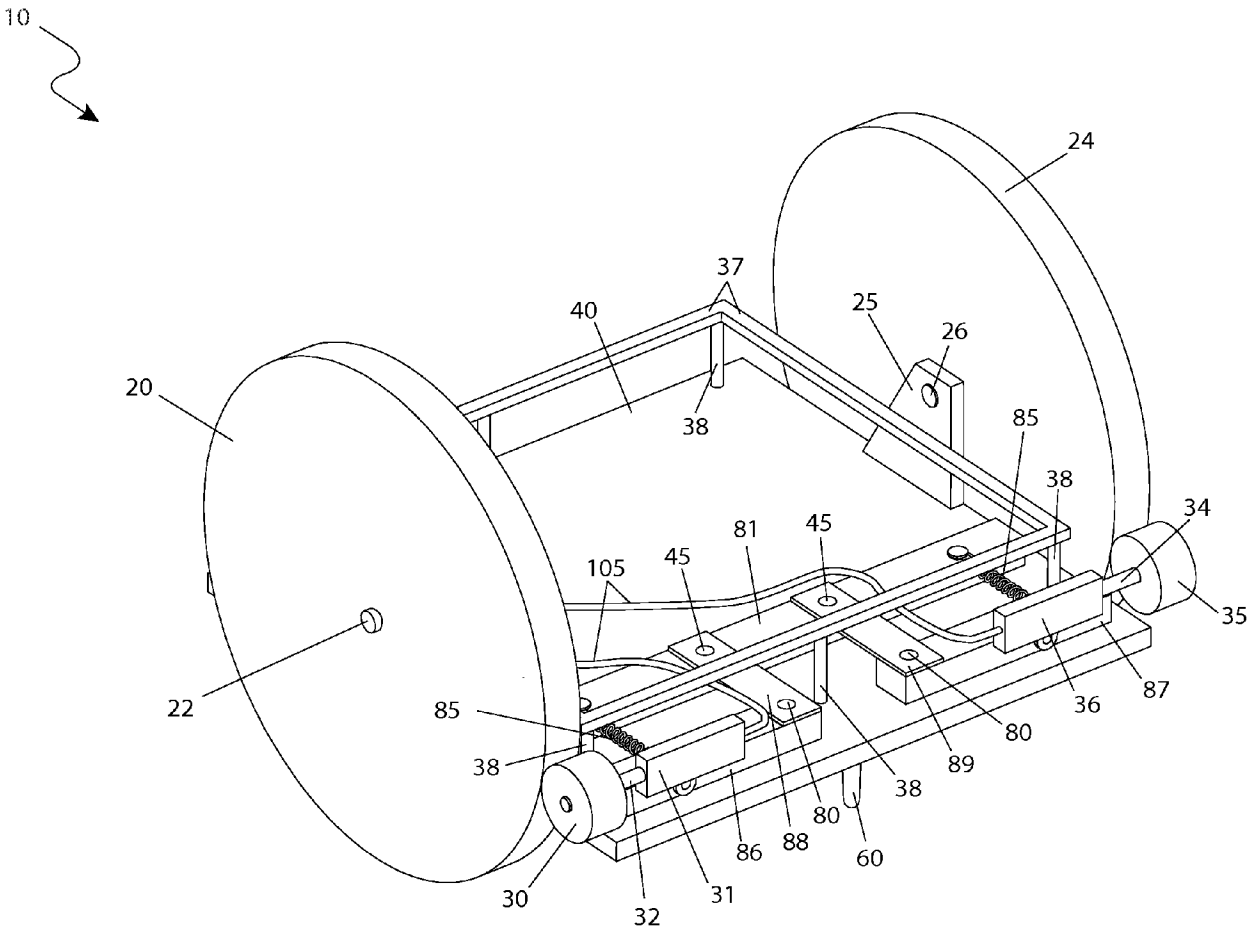
FIG. 1 is a perspective view of a driving mechanism for a radio-controlled toy 10, according to a preferred embodiment of the present invention.

10 driving mechanism for a compartment radio-controlled toy
12 remote control
20 first wheel
21 first wheel brace
22 first wheel axle
24 second wheel
25 second wheel brace
26 second wheel axle
30 first drive wheel
31 first drive motor
32 first drive wheel axle
34 second drive wheel axle
35 second drive wheel
36 second drive motor
37 railing
38 leg
39 aperture
40 platform
50 enclosing structure
60 finger
70 first power source
71 first power source
72 driving mechanism activation switch
75 circuitry
76 receiver
80 hinging bearing
81 support beam
85 spring
86 first rotating member
87 second rotating member
88 first pivoting member
89 second pivoting member
90 remote body
91 remote circuitry
92 antenna/transmitter
93*a* first joystick
93*b* second joystick
94*a* first switch
94*b* second switch
94*c* third switch
95 second power source
96 second power source compartment
100 signal
105 electrical wiring

DETAILED DESCRIPTION OF THE PREFERRED EMBODIMENT

In accordance with the invention, the best mode is presented in terms of a preferred embodiment, herein depicted within FIGS. 1 through 6. However, the disclosure is not limited to a single described embodiment and a person skilled in the art will appreciate that many other embodiments are possible without deviating from the basic concept of the disclosure and that any such work around will also fall under its scope. It is envisioned that other styles and configurations can be easily incorporated into the teachings of the present disclosure, and only one particular configuration may be shown and described for purposes of clarity and disclosure and not by way of limitation of scope.

The terms "a" and "an" herein do not denote a limitation of quantity, but rather denote the presence of at least one of the referenced items.

The present invention describes a driving mechanism for a radio-controlled toy (herein described as the "apparatus") 10, which provides enhanced driving features comprising a pair of large wheels 20, 24 to enable said apparatus 10 to easily travel on rough grade such as gravel, carpeting, or the like. The apparatus 10 comprises a remote control 12 to enable an operator to manipulate said apparatus 10.

Figure 2:
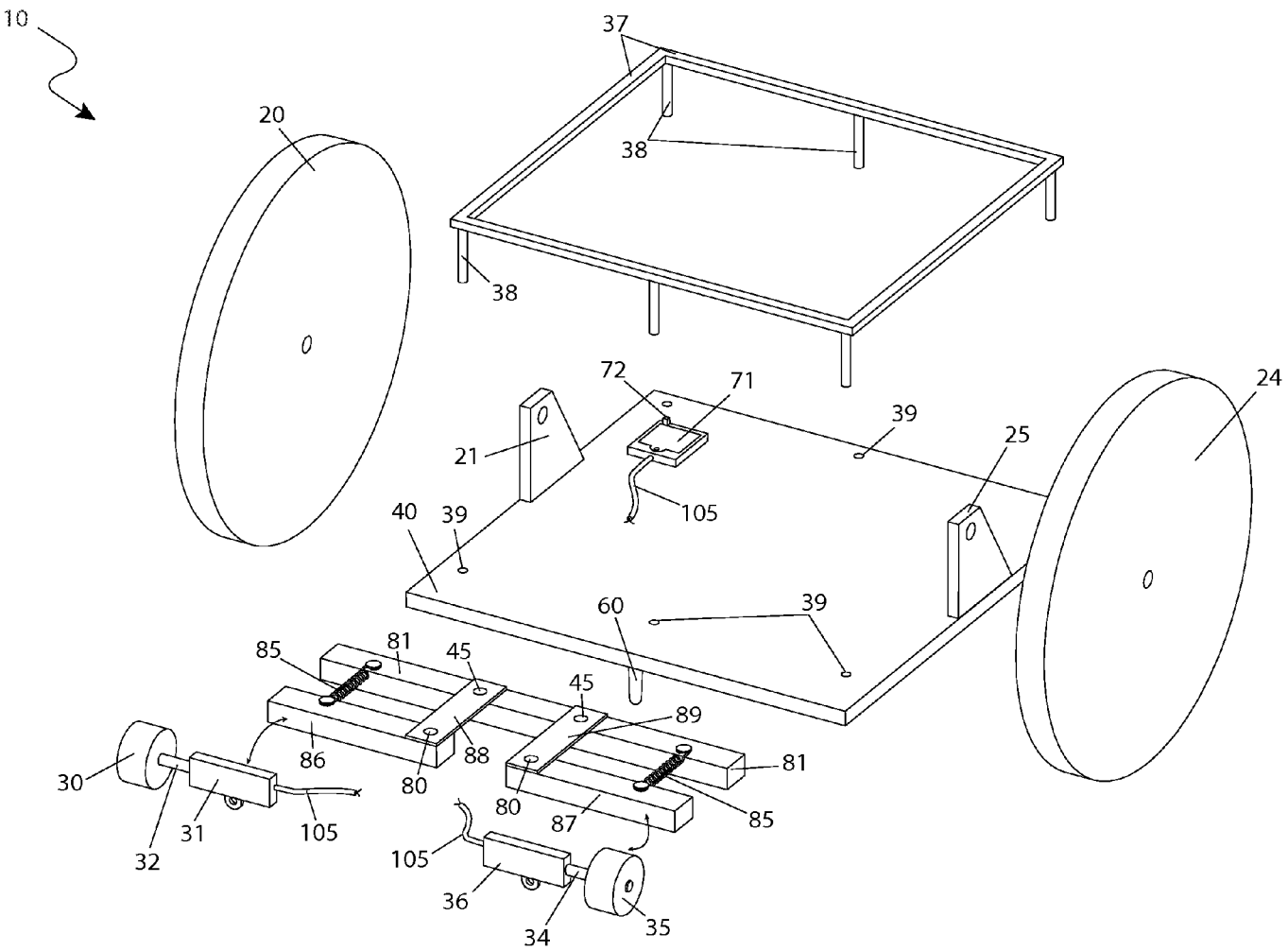
FIG. 2 is an exploded perspective view of the driving mechanism for a radio-controlled toy 10, according to a preferred embodiment of the present invention.

Referring now to FIG. 1, a perspective view of the apparatus 10 and FIG. 2, an exploded perspective view of the apparatus 10, according to the preferred embodiment of the present invention, are disclosed. The apparatus 10 comprises a rectangular platform 40 which provides a supporting structure to a first wheel 20, a second wheel 24, and corresponding electrical and mechanical components. The platform 40 is fabricated from materials such as, but not limited to: wood, plastic, metal, or the like. A front underside portion of the platform 40 comprises a plastic finger 60 which measures approximately half the distance from underside of the platform 40 to the ground surface. The finger 60 is preferably integrally molded to the platform 40, yet other attachment means may be utilized without limiting the scope of the apparatus 10. The finger 60 assists in prohibiting the apparatus 10 from rocking while in motion. Although a single finger 60 is being depicted it is known that a pair may be utilized, one (1) in the front and one (1) in the back, without limiting the scope of the apparatus 10. An upper surface of the platform 40 also comprises a removably attachable railing 37 which fences-in an area upon said platform 40 to retain an action figure, doll, or the like to be positioned. The railing 37 includes a plurality of legs 38 which are friction fit into corresponding apertures 39 upon the platform 40 to secure said railing 37 to said platform 40. The railing 37 and legs 38 are preferably fabricated from a material similar to the platform 40.

Opposing side intermediate surfaces of the platform 40 also comprise a first wheel brace 21 and a second wheel brace 25 which provide an attachment to a respective first wheel 20 and a second wheel 24. The wheel braces 21, 25 are depicted herein as comprising a triangular shape for illustration purposes only it is known that other shapes may be utilized without limiting the scope of the apparatus 10. The wheels 20, 24 attach to the respective wheel braces 21, 25 via a first wheel axle 22 and a second wheel axle 26 which enable each said wheels 20, 24 to rotate freely. The wheel braces 21, 25 are attached to the platform 40 via fastening means such as, but not limited to: bolts and nuts, interference fitting, integral molding, or the like. The wheel braces 21, 25 are fabricated from similar materials as the platform 40, yet other materials may be utilized without limiting the functions of the apparatus 10. The first wheel 20 and second wheel 24 are considerably large in diameter to provide smooth control of the apparatus 10. The wheels 20, 24 are approximately eight (8) inches in diameter and are preferably a variety of differing colors or patterns which assist the user in controlling the apparatus 10 via a remote control 12 (see FIGS. 4 and 5) by visually indicating which wheel 20, 24 corresponds with a desired joystick 93*a*, 93*b*. The wheels 20, 24 are preferably fabricated from materials such as, but not limited to: wood, plastic, or the like and may be further coated with a rubber or other traction enhancing feature which increase the mobility of the apparatus 10.

The drive wheels 30, 35 provide a driving means to a first wheel 20 and second wheel 24, respectively. Said drive wheels 30, 35 are preferably conventional servo driven wheels, yet other motor devices may be utilized without limiting the features of the apparatus 10. In use, as the drive wheels 30, 35 are tangentially engaged along a circumferential surface of the respective wheels 20, 24 a proportional rotation of said wheels 20, 24 enables the apparatus 10 to move along a desired path. The first drive wheel 30 is powered by a first drive motor 31 and the second drive wheel 35 is powered by a second drive motor 36. The first drive motor 31 and the second drive motor 36 enable the corresponding drive wheels 30, 35 to rotate. The first drive motor 31 is engaged with the first drive wheel 30 by a first drive wheel axle 32 and the second drive motor 36 is engaged to the second drive wheel 35 by a second drive wheel axle 34. Each drive motor 31, 36 is interconnected to circuitry 75 and a first power source 70 via appropriately gauged conventional electrical wiring 105.

In use, a current is sent via the electrical wiring 105 from a power source 70 to the circuitry 75 and concurrently to each drive motor 31, 36 which enable the drive motors 31, 36 to rotate and further rotate the respective drive wheels 30, 35 and wheels 20, 24. The circuitry 75 is located within a first power source compartment 71 which is further located upon a top surface of the platform 40 and comprises components such as, but not limited to: a receiver 76, microcontroller, electrical wiring 105, or the like (also see FIG. 6). The first power source compartment 71 also comprises a first power source 70 which supplies current to the drive motors 31, 36. The power source 70 preferably comprises an appropriate amount of user replaceable batteries, yet other power sources may be utilized without limiting the functions of the apparatus 10. The power source 70 also provides additional weight to the rear of the apparatus 10 which enables additional control to the driving feature. Further the first power source compartment 71 also comprises a driving mechanism activation switch 72 which initiates or ceases power to the drive motors 31, 36. The driving mechanism activation switch 72 is preferably a common toggle switch, yet other devices may be utilized without limiting the scope of the apparatus 10.

Attached to an upper front surface of the platform 40 is a support beam 81 which is integrally molded to said platform 40 and enables a hinging attachment to each drive motor 31, 36 and attached drive wheels 30, 35. A first pivoting member 88 and a second pivoting member 89 are equally spaced from a centerline of and intermediately fastened to the support beam 81 via a common mechanical fastener 45 such as a bolt, screw, or the like. An opposing end of each pivoting member 88, 89 is attached to a respective rotating member 86, 87 via a hinging bearing 80 which enables the pivoting members 88, 89 to hinge about a respective rotating member 86, 87. The rotating members 86, 87 provides a surface for each respective drive motor 31, 36 to attach to and provides flexibility between the first wheel 20 and the first drive wheel 30 and the second wheel 24 and the second drive wheel 35. Attached to each rotating member 86, 87 and support beam 81 is a corresponding spring 85 which provides tension to enable that each drive wheel 30, 35 is engaged against the respective wheel 20, 24 and enables said rotating member 86, 87 to change direction when an applied force is present.

Figure 3:
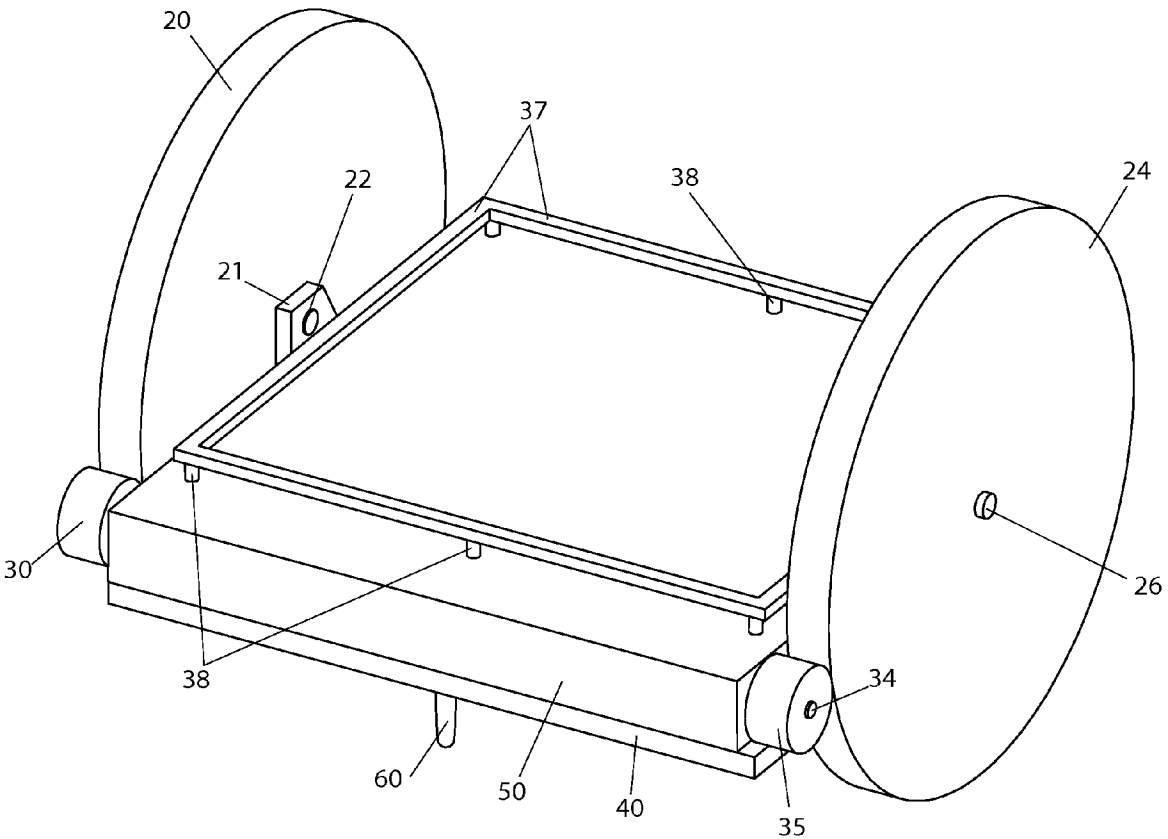
FIG. 3 is another perspective view of a driving mechanism for a radio-controlled toy 10 depicting an enclosing structure 50, according to a preferred embodiment of the present invention.

Referring now to FIG. 3, another perspective view of the apparatus 10 depicting an enclosing structure 50, according to the preferred embodiment of the present invention, is disclosed. Alternately, an upper portion of the platform 40 may comprise an enclosing structure 50 which protects the electrical and mechanical components from debris, blunt force, or other hazards. The enclosing structure 50 is attached to the platform 40 via fastening means such as, but not limited to: interference fitting, screws, or the like, which will provide access to the electrical and mechanical components at an internal portion. The railing 37 is also depicted as being positioned superjacent to the enclosing structure 50 and attached to said enclosing structure 50 similar to the above-mentioned attachment. The enclosing structure 50 is fabricated from materials such as, but not limited to: wood, plastic, metal, or the like.

Figure 5:
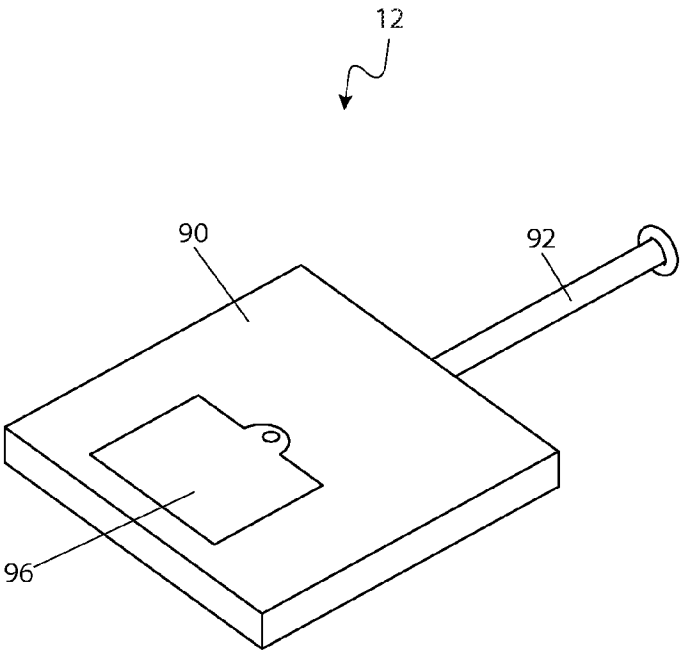
FIG. 5 is a rear perspective view of the remote control 12, according to a preferred embodiment of the present invention; and, FIG. 6 is an electrical block diagram of the driving mechanism for a radio-controlled toy 10, according to a preferred embodiment of the present invention.
Figure 4:
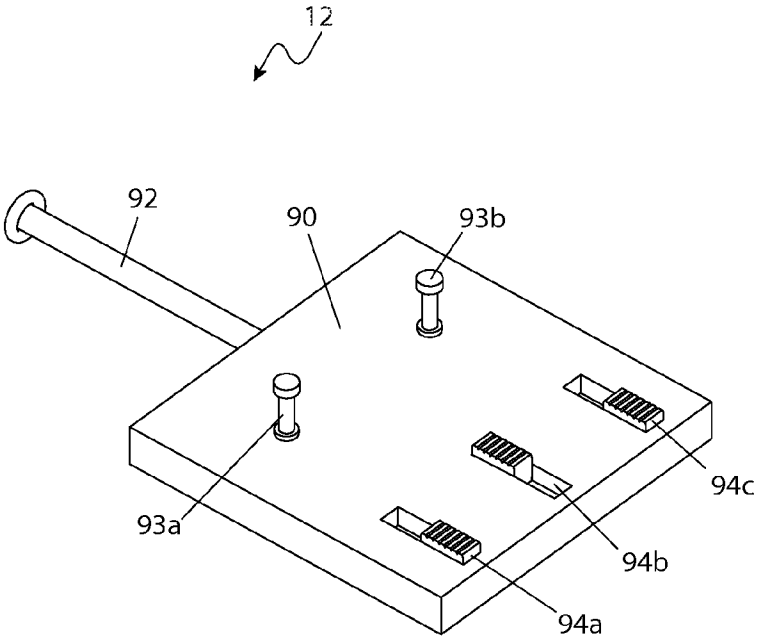
FIG. 4 is a front perspective view of a remote control 12, according to a preferred embodiment of the present invention.

Referring now to FIG. 4, a front perspective view of the remote control 12 and FIG. 5, a rear perspective view of the remote control 12, according to the preferred embodiment of the present invention, are disclosed. The apparatus 10 also comprises a remote control 12 which provides a manual control device to motion or direct the apparatus 10 to a desired area. The remote control 12 comprises a rectangular remote body 90 preferably fabricated from a plastic materials, yet other materials may be utilized without limiting the functions of the apparatus 10. The remote body 90 comprises an antenna transmitter 92, a pair of joysticks 93*a*, 93*b*, and a plurality of switches 94*a*, 94*b*, 94*c*. The antenna transmitter 92 transmits a desired signal 100 to the receiver 76 upon the apparatus 10 via input from the joysticks 93*a*, 93*b* and switches 94*a*, 94*b*, 94*c* (also see FIG. 6). The joysticks 93*a*, 93*b* control the driving features of the apparatus 10 such as, but not limited to: a forward motion, a backward motion, a right turn, and a left turn of each wheel 20, 24. A first joystick 93*a* drives the first drive motor 31 and a second joystick 93*b* drives a second drive motor 36, independently from each other which enable the wheels 20, 24 to drive in opposite directions if desired. The first switch 94*a* preferably controls the activation of the remote control 12, the second switch 94*b* preferably controls the frequency of the remote control 12 and, the third switch 94*c* preferably inverts the controls. The switches 94*a*, 94*b*, 94*c* are preferably electrical switching devices such as, but not limited to: pushbuttons, slide switches, toggle switches, or the like. The antenna transmitter 92, joysticks 93*a*, 93*b*, and switches 94*a*, 94*b*, 94*c* are managed via a plurality of remote circuitry 91 which may comprise a integrated circuit to control the functions and relay the signal 100 to the receiver 76. A rear surface of the remote control 12 comprises a second power source compartment 96 which encloses a second power source 95. The second power source compartment 96 is preferably removed in conventional manners to access the second power source 95 as desired. The second power source 95 is preferably a common user replaceable battery, yet other sources may be utilized without limiting the scope of the invention.

Figure 6:
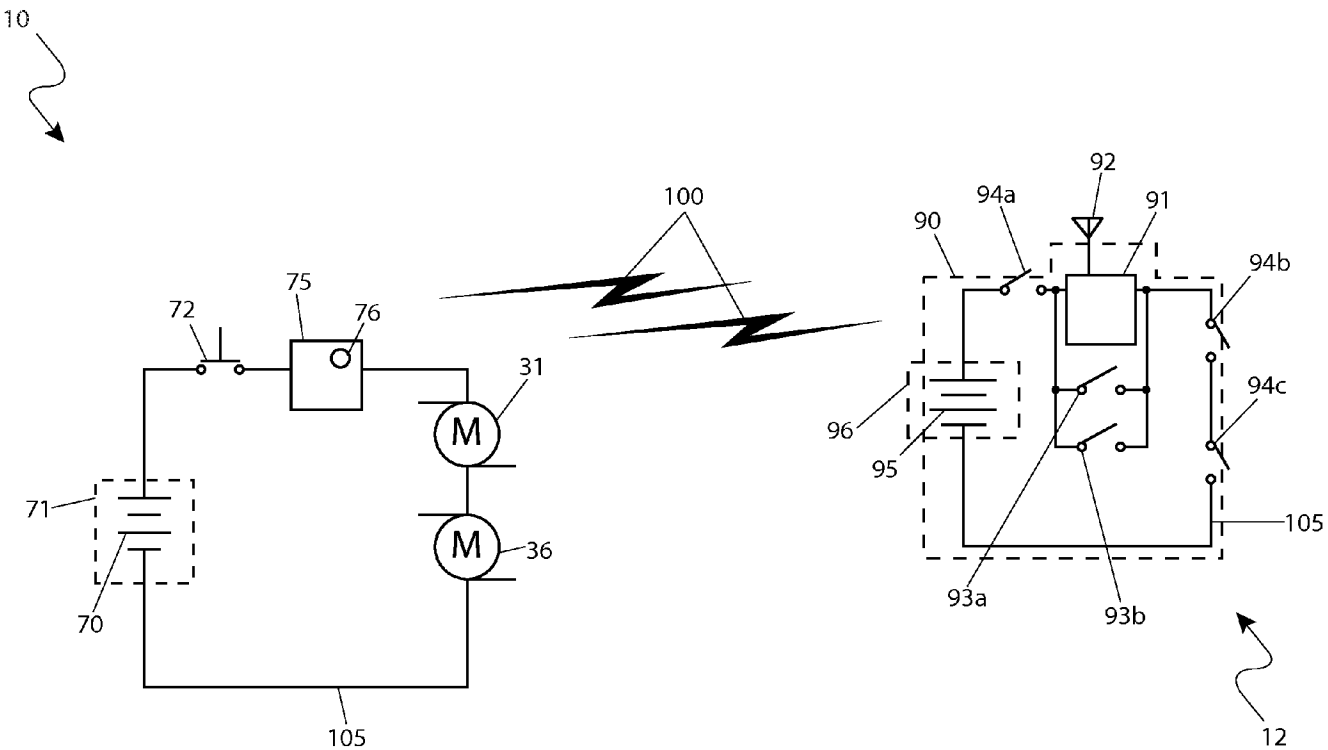

Referring now to FIG. 6, an electrical block diagram depicting the major electrical components of the apparatus 10, according to the preferred embodiment of the present invention, is disclosed. The first power source 70 sends current to the driving mechanism activation switch 72 when, once activated, sends current to the circuitry 75, receiver 76, and drive motors 31, 36. The receiver 76 accepts a signal 100 from the remote control 12, which enables said remote control 12 to direct the actions of the apparatus 10 via the joysticks 93*a*, 93*b*. The remote control 12 comprises a plurality of remote circuitry 91, a pair of joysticks 93*a*, 93*b*, a plurality of switches 94*a*, 94*b*, 94*c*, and a second power source 95 enclosed within the remote body 90. The joysticks 93*a*, 93*b* are conventional digit-operated pivoting devices utilized as directional controlling means. Current is sent from the second power source 95 to the remote circuitry 91 and corresponding joysticks 93*a*, 93*b* and switches 94*a*, 94*b*, 94*c* that which transmit the signal 100 to the receiver 76 which advise the apparatus 10 to move in a desired path.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the apparatus 10, it would be installed as indicated in FIG. 1.

The method of utilizing the apparatus 10 may be achieved by performing the following steps: acquiring the apparatus 10; positioning the remote control 12 in an on position via a first switch 94*a*; positioning the apparatus 10 to an on position via the driving mechanism activation switch 72; setting a desired setting upon the remote control 12 via the switches 94*b*, 94*c*; moving a desired one (1) of the first joystick 93*a* or second joystick 93*b* in a desired direction, thereby sending a signal 100 via the antenna/transmitter 92 to the receiver 76; allowing a current to be sent from the first power source 70 to the motors 31, 36, thereby driving the drive wheels 30, 35 and correspondingly driving the wheels 20, 24 in a desired path; and, utilizing the larger diameter wheels 20, 24 to allow the apparatus 10 to easily travel on desired surfaces in a are functional and fun manner.

The foregoing descriptions of specific embodiments have been presented for purposes of illustration and description. They are not intended to be exhaustive or to limit the invention and method of use to the precise forms disclosed. Various modifications and variations can be appreciated by one skilled in the art in light of the above teachings. The embodiments have been chosen and described in order to best explain the principles and practical application in accordance with the invention to enable those skilled in the art to best utilize the various embodiments with expected modifications as are suited to the particular use contemplated. It is understood that various omissions or substitutions of equivalents are contemplated as circumstance may suggest or render expedient, but is intended to cover the application or implementation without departing from the spirit or scope of the claims of the invention.

What is claimed is:

1. A driving mechanism for a remote-controlled toy, said driving mechanism comprising:

a platform;

first and second wheel braces attached to said platform;

first and second wheels rotatably attached to said first and second wheel braces respectively;

first and second drive wheels having first and second drive wheel axles respectively;

first and second drive motors mated to said first and second drive wheel axles respectively, wherein said first and second drive wheels are rotatably mated to said first and second wheels respectively;

a support beam attached to said platform;

first and second pivoting members fastened to said support beam;

first and second rotating members pivotally attached to said first and second pivoting member respectively;

wherein said first and second rotating members are further attached to said first and second drive motors respectively such that said first and second drive wheels are flexibly engaged with said first and second wheels respectively;

a receiver communicatively coupled to said first and second drive motors; and, a remote control communicatively coupled to said receiver;

wherein said remote control is capable of independently controlling operation of each of said drive motors;

wherein said first and second drive wheels are located exterior of said first and second wheels respectively;

wherein each of said first and second drive wheels has a smooth outer circumferential surface, wherein each of said first and second wheels has a smooth outer circumferential surface; and, wherein said smooth outer circumferential surface of said first and second drive wheels is rotatably engaged with said smooth outer circumferential surface of said first and second wheels respectively.

2. The driving mechanism of claim 1, wherein said first and second drive wheels are tangentially engaged along a circumferential surface of said first and second wheels.

3. The driving mechanism of claim 1, further comprising:

a first spring attached to said first rotating member and said support beam;

a second spring attached to said second rotating member and said support beam;

wherein said first and second springs provide tension to said first and second drive wheels respectively and thereby maintain engagement between said first and second drive wheels and said first and second wheels.

4. The driving mechanism of claim 1, further comprising a railing removably attached to an upper surface of said platform and thereby fencing-in an area upon said platform, wherein said railing includes a plurality of legs frictionally fit to said platform.

5. The driving mechanism of claim 1, further comprising a finger attached to a front underside portion of said platform.

6. The driving mechanism of claim 1, further comprising an enclosing structure attached to an upper surface of said platform.

7. The driving mechanism of claim 1, wherein said remote control comprises first and second joysticks capable of independently driving said first and second motors.

8. The driving mechanism of claim 7, wherein said remote control further comprises:

a first switch capable of activating said remote control;

a second switch capable of controlling an operating frequency of said remote control; and, a third switch capable of inverting operating characteristics of said first and second joysticks.

9. A driving mechanism for a remote-controlled toy, said driving mechanism comprising:

a platform having a planar upper surface;

first and second wheel braces attached to said platform;

first and second wheels rotatably attached to said first and second wheel braces respectively;

first and second drive wheels having first and second drive wheel axles respectively;

first and second drive motors mated to said first and second drive wheel axles respectively, wherein said first and second drive wheels are rotatably mated to said first and second wheels respectively;

a support beam attached to said platform;

first and second pivoting members fastened to said support beam;

first and second rotating members pivotally attached to said first and second pivoting member respectively;

wherein said first and second rotating members are further attached to said first and second drive motors respectively such that said first and second drive wheels are flexibly engaged with said first and second wheels respectively;

a receiver communicatively coupled to said first and second drive motors; and, a remote control communicatively coupled to said receiver;

wherein said remote control is capable of independently controlling operation of each of said drive motors;

wherein said first and second drive wheels are located exterior of said first and second wheels respectively;

wherein each of said first and second drive wheels has a smooth outer circumferential surface, wherein each of said first and second wheels has a smooth outer circumferential surface; and wherein said smooth outer circumferential surface of said first and second drive wheels is rotatably engaged with said smooth outer circumferential surface of said first and second wheels respectively.

10. The driving mechanism of claim 9, wherein said first and second drive wheels are tangentially engaged along a circumferential surface of said first and second wheels.

11. The driving mechanism of claim 9, further comprising:

a first spring attached to said first rotating member and said support beam;

a second spring attached to said second rotating member and said support beam;

wherein said first and second springs provide tension to said first and second drive wheels respectively and thereby maintain engagement between said first and second drive wheels and said first and second wheels.

12. The driving mechanism of claim 9, further comprising a railing removably attached to said upper surface of said platform and thereby fencing-in an area upon said platform, wherein said railing includes a plurality of legs frictionally fit to said platform.

13. The driving mechanism of claim 9, further comprising a finger attached to a front underside portion of said platform.

14. The driving mechanism of claim 9, further comprising an enclosing structure attached to said upper surface of said platform.

15. The driving mechanism of claim 9, wherein said remote control comprises first and second joysticks capable of independently driving said first and second motors.

16. The driving mechanism of claim 15, wherein said remote control further comprises:

a first switch capable of activating said remote control;

a second switch capable of controlling an operating frequency of said remote control; and, a third switch capable of inverting operating characteristics of said first and second joysticks.

17. A method of utilizing a driving mechanism for a remote-controlled toy, said method comprising the steps of:

providing a platform having a planar upper surface;

providing and attaching first and second wheel braces to said platform;

providing and rotatably attaching first and second wheels to said first and second wheel braces respectively;

providing first and second drive wheels having first and second drive wheel axles respectively;

providing and mating first and second drive motors to said first and second drive wheel axles respectively;

rotatably mating said first and second drive wheels to said first and second wheels respectively;

providing and communicatively coupling a receiver to said first and second drive motors;

providing and communicatively coupling a remote control to said receiver;

providing and attaching a support beam to said platform;

providing and fastening first and second pivoting members to said support beam;

providing and pivotally attaching first and second rotating members to said first and second pivoting member respectively;

attaching said first and second rotating members to said first and second drive motors respectively such that said first and second drive wheels flexibly engage said first and second wheels respectively; and, said remote control independently controlling operation of each of said drive motors;

wherein said first and second drive wheels are located exterior of said first and second wheels respectively;

wherein each of said first and second drive wheels has a smooth outer circumferential surface, wherein each of said first and second wheels has a smooth outer circumferential surface; and, wherein said smooth outer circumferential surface of said first and second drive wheels is rotatably engaged with said smooth outer circumferential surface of said first and second wheels respectively.

* * * * *